US007290861B2

(12) United States Patent
Inoue et al.

(10) Patent No.: US 7,290,861 B2
(45) Date of Patent: Nov. 6, 2007

(54) INK TANK, PRINTING HEAD AND INKJET PRINTING APPARATUS

(75) Inventors: Ryoji Inoue, Kawasaki (JP); Ryoichi Matsumoto, Meguro-ku (JP); Shogo Kawamura, Numazu (JP); Hideki Ogura, Kawasaki (JP); Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/563,674

(22) PCT Filed: Jun. 6, 2005

(86) PCT No.: PCT/JP2005/010734

§ 371 (c)(1),
(2), (4) Date: Jan. 6, 2006

(87) PCT Pub. No.: WO2005/120838

PCT Pub. Date: Dec. 22, 2005

(65) Prior Publication Data

US 2006/0170742 A1 Aug. 3, 2006

(30) Foreign Application Priority Data

Jun. 7, 2004 (JP) ..... 2004-169110

(51) Int. Cl.
*B41J 2/14* (2006.01)
*B41J 2/175* (2006.01)

(52) U.S. Cl. ..... 347/49; 347/87

(58) Field of Classification Search ..... 347/85, 347/86, 87; 141/2, 18
See application file for complete search history.

(56) References Cited

U.S. PATENT DOCUMENTS

| | | | | |
|---|---|---|---|---|
| 6,130,695 | A * | 10/2000 | Childers et al. | 347/85 |
| 6,332,481 | B1 | 12/2001 | Shinada et al. | 141/18 |
| 6,773,099 | B2 | 8/2004 | Inoue et al. | 347/86 |
| 6,824,254 | B2 * | 11/2004 | Koike et al. | 347/71 |
| 6,830,324 | B2 | 12/2004 | Ogura et al. | 347/86 |
| 6,837,577 | B1 * | 1/2005 | Anderson et al. | 347/85 |
| 6,854,836 | B2 | 2/2005 | Ishinaga et al. | 347/85 |

(Continued)

FOREIGN PATENT DOCUMENTS

JP 7-241998 9/1995

(Continued)

*Primary Examiner*—Anh T. N. Vo
(74) *Attorney, Agent, or Firm*—Fitzpatrick, Cella, Harper & Scinto

(57) ABSTRACT

An inkjet printing apparatus includes a mechanism for opening and closing an ink supply route between an ink tank and a printing head and capable of attaching and removing the ink tank by a horizontal movement. More specifically, a moving member 60 and the communication pipe 51 engaged therewith are moved upward by moving an operation member 70 upward. As a result, the communication pipe 51 moves into an ink lead chamber 16 and a communication channel 52 of the communication pipe 51 comes into communication with the ink lead chamber 16 through its opening. In this way, the ink lead chamber 16, namely, an ink storage chamber 12 comes into communication with a liquid chamber 50 of a printing head 20. An ink supply route is opened in this manner. The ink supply route is closed by the reverse operation to that mentioned above.

15 Claims, 7 Drawing Sheets

U.S. PATENT DOCUMENTS

| | | | | |
|---|---|---|---|---|
| 6,908,180 | B2 * | 6/2005 | Dietl | 347/85 |
| 6,969,161 | B2 | 11/2005 | Kuwabara et al. | 347/85 |
| 7,077,514 | B2 | 7/2006 | Inoue et al. | 347/86 |
| 7,097,288 | B2 * | 8/2006 | Van Os et al. | 347/85 |
| 7,128,407 | B2 | 10/2006 | Inoue et al. | 347/85 |
| 2005/0068349 | A1 | 3/2005 | Matsumoto et at. | 347/7 |
| 2005/0270342 | A1 | 12/2005 | Ogura et al. | 347/85 |
| 2005/0270345 | A1 | 12/2005 | Katsuyama et al. | 347/86 |
| 2006/0017787 | A1 | 1/2006 | Inoue et al. | 347/85 |

FOREIGN PATENT DOCUMENTS

| | | |
|---|---|---|
| JP | 2000-289224 | 10/2000 |
| JP | 2004-82403 | 3/2004 |
| JP | 2004-106397 | 4/2004 |
| WO | 00/58100 | 10/2000 |

* cited by examiner

INK TANK, PRINTING HEAD AND INKJET PRINTING APPARATUS

TECHNICAL FIELD

The present invention relates to an ink tank, a printing head and an inkjet printing apparatus, and more specifically, relates to a mechanism for attaching and removing an ink tank to and from a printing head which ejects ink supplied from the ink tank. The present invention also relates to a liquid storage container which contains a liquid like the ink tank and supplies the liquid to a liquid utilizing machine by attaching and removing the ink tank to and from the liquid utilizing machine.

BACKGROUND ART

An inkjet printing apparatus for forming an image on a printing medium by applying ink onto the printing medium by use of a printing head has an advantage in that it can form small dots in high density with relatively less noise during printing and therefore used in various types of printings such as color printing. One type of such an inkjet printing apparatus has a printing head receiving an ink supply from an ink tank detachably connected thereto, a carriage having the printing head mounted thereon and moving the printing head relative to a printing medium in a scanning manner in a predetermined direction (main scanning direction), and a transfer mechanism transferring the printing medium relative to the printing head in a direction (sub scanning direction) perpendicular to the aforementioned predetermined direction, and performs printing by ejecting ink while the printing head scans in the main scanning direction. In this apparatus, printing heads ejecting color inks such as yellow, cyan, and magenta in addition to black are mounted on the carriage. By this configuration, not monochrome printing of a text image by using black ink but also full color printing by ejecting color inks can be made.

An ink supply system constituted of the ink tank and the printing head in such an inkjet printing apparatus has a mechanism where the ink tank and the printing head can be attached and removed to and from each other, and mostly, when the ink tank and the printing head are attached, an ink supply route from the ink tank to the printing head is simultaneously formed. This mechanism allows the ink supply route from the ink tank to the printing head to be shortened and thereby the size of the printing apparatus can be reduced. It is further advantageous in that the ink supply can be made by simply replacing the ink tank with a new one, thereby reducing running cost.

The above ink supply system, since the ink tank and the printing head are separable, is desired to satisfy at least the following conditions. First, leakage of ink must be prevented at the time when the printing head and the ink tank are attached and removed regardless posture of the ink tank. Second, ink is stably supplied while they are attached. Third, since it is presumable that a user may repeat attaching and removing of them, the conditions required during attaching and removing time must be satisfied in every single time such a attaching and removing are repeated.

Japanese Patent Application Laid-Open Nos. 07-241998 and 2000-289224 show an example of a conventional ink supply system. More specifically, a printing head has a conduit for introducing ink therein. When the printing head is attached to an ink tank, the conduit is brought into contact with an ink guide member within the ink tank. In this manner, ink from the ink tank is communicated to the printing head. By virtue of this mechanism of this system, ink can be supplied through a pipe-like member.

Japanese Patent Application Laid-Open Nos. 07-241998 and 2000-289224 further describe that an ink tank has an open/close valve serving as an ink supply route open/close mechanism. During removed time of the ink tank from the printing head, the ink tank is closed airtight by the valve, whereas, during attached time of the ink tank to the printing head, the valve is opened to form the ink supply route.

However, in the ink supply system having the ink supply route open/close mechanism described in Japanese Patent Application Laid-Open Nos. 07-241998 and 2000-289224, operations of attaching and removing the ink tank while opening and closing the valve respectively are operations including moving the ink tank in a vertical direction. Because of this, these operations cause a problem of spatial limitation for the printing apparatus, and a problem residing in that relatively complicated user's operation is required during attaching and removing of the ink tank. More specifically, in the ink supply system, the printing head is usually arranged below the ink tank and an open/close valve is attached to the bottom of the ink tank, as shown in Japanese Patent Application Laid-Open No. 2000-289224. This is because ink is allowed to gather at the bottom of the ink tank by gravitation and transfer efficiently to the printing head arranged below the ink tank so as not to leave ink in the ink tank. In this case, the ink supply route open/close mechanism opens the open/close valve, in most cases, by a vertical operation of the ink tank for attaching to the printing head. However, when the ink tank is installed by gaining access to the printing head downward from the right above, a relatively large space must be kept above the region where the printing head moves in a scanning manner, for the user's operation for installation. More specifically, it is necessary to keep the space corresponding to the length of the ink tank in the insertion direction or the space large enough for the user's hand having the ink tank to get in. Such a large space gives limitations when a printing apparatus is designed. Furthermore, in a so-called front loading type printing apparatus often employed in facsimiles (multifunction printers), it is difficult to apply the aforementioned system where attaching/removing of an ink tank placed in the above is performed.

Furthermore, when the ink tank is installed to the printing head by approaching the ink tank to the printing head vertically from above, the ink tank must be installed to the printing head while aligning the open/close valve of the ink tank with a connecting portion of the printing head. Therefore, the operation for installation becomes complicated. In connection with this, it is a trend to be desired that a printing apparatus is made compact with a reduced height. Therefore, the number of ink tanks low in height when installed to a printing heads has been increased. Accordingly, the length of the ink tank in the horizontal direction has been increased by just that much in order to keep the volume of the ink tank without reducing Therefore, when such a horizontal-long ink tank is installed, if the ink tank is tilted even slightly during the installation, positional deviation takes place between the open/close valve and the connecting portion of the printing head. Because of the positional deviation, it is necessary for the user to perform a relatively intricate operation for aligning them. If the ink tank is forcibly installed while the open/close valve and the connecting portion are aligned with deviation, leakage of ink may occur and the open/close valve may be broken.

To align between the open/close valve and the connecting portion of the printing head, it may be conceivable that a guide is provided to the printing head and the ink tank to improve the alignment accuracy during the installation. However, the presence of the guides complicates the structure of the apparatus.

DISCLOSURE OF THE INVENTION

An object of the present invention is to provide an ink tank having a mechanism for opening and closing an ink supply route between an ink tank and a printing head and being capable of attaching and removing the ink tank, which is to be installed on the printing head, to the printing head, by operation in a horizontal direction, and also provide a printing head and an inkjet printing apparatus using such a ink tank.

In a first aspect of the present invention, there is provided an ink tank arranged vertically above a printing head for used, and capable of attached to and removed from the printing head, said ink tank comprising:

a moving member for engaging with a communication member having a communication channel communicating with the printing head with an attaching operation of the said ink tank to the printing head, and being moved upward to guide the communication member into an ink storage portion of said ink tank being attached.

In a second aspect of the present invention, there is provided a printing head for ejecting ink supplied from an ink tank arranged vertically above said printing head, said printing head comprising:

a communication member for engaging with a moving member of the ink tank with an attaching operation of the ink tank to said printing head, and having a communication channel being guided into an ink storage portion of the ink tank being attached by the movement of the moving member.

In a third aspect of the present invention, there is provided an ink jet printing apparatus that uses a printing head for ejecting ink and an ink tank arranged vertically above the printing head for used, and capable of attached to and removed from the printing head, and ejects ink to a printing medium, so as to perform printing, said ink jet printing apparatus comprising:

a moving member for engaging with a communication member having a communication channel communicating with the printing head with an attaching operation of the said ink tank to the printing head, and being moved upward to guide the communication member into an ink storage portion of said ink tank being attached.

In a fourth aspect of the present invention, there is provided a liquid storage container capable of attached to and removed from a liquid using device, said container comprising:

a moving member for engaging with a communication member having a communication channel communicating with the liquid using device with an attaching operation of the said liquid storage container to the liquid using device, and being moved upward to guide the communication member into a liquid storage portion of said liquid storage container being attached.

According to the above structure, there is provided a moving member for engaging with a communication member having a communication route communicating with a printing head with installation operation of an ink tank to the printing head, and for introducing the communication member into an ink storage portion within the tank by the upward motion of the moving member. Thereby, even in the case where the ink tank is installed right above the printing head, engaging the communication member and the moving member with each other by moving the ink tank horizontally, and then the ink tank can be attached and removed by an operation in the horizontal direction. Furthermore, since engagement of the above mentioned members can be made even if alignment accuracy thereof is low to some extent, it is not necessary to care about such accuracy in engagement when the ink tank is installed.

Note that from the aforementioned conventional technique, it is possible to conceive a configuration of an ink tank which can be attached and removed in the horizontal direction. However, to attain such a horizontal attaching/removing, an open/close valve described in Japanese Application Patent Laid-Open No. 2000-289224 cannot be simply applied as a mechanism for opening or closing an ink supply route from the an ink tank to a printing head. More specifically, the open/close valve of the ink tank disclosed in Japanese Patent Application Laid-Open No. 2000-289224 is opened by engaging with a supply pipe of the printing head during its installation operation. Therefore, the portion corresponding to the supply pipe must be arranged in the extension line of the portion where the ink tank is to be installed. As a result, the size of the ink tank installation section in the horizontal direction inevitably increases by the size of the supply pipe. In addition, the open/close valve must be accurately aligned with the supply pipe for engagement thereof. In contrast, the present invention, the moving member is operated in a vertical direction as mentioned above. It is clear that the ink supply route open/close mechanism according to the present invention differs from a valve mechanism described in Japanese Patent Application Laid-Open No. 2000-289224. More specifically, even if the valve is applied to the present invention by simply changing the direction, it will not reach the ink supply route open/close mechanism of the present invention.

According to the present invention, the user loads an ink tank along with the bottom surface of the ink tank installation section on which the ink tank is placed. Therefore, it is possible to improve the positional accuracy in the height direction. Furthermore, even if a positional deviation takes place between the moving member and the communication pipe, more or less, during the movement of an operation member for introducing a communication member into the ink tank, the axis centers of both members agree by repulsion force of an elastic member such as sealing member, thereby correcting such a positional deviation.

The above and other objects, effects, features and advantages of the present invention will become more apparent from the following description of embodiments thereof taken in conjunction with the accompanying drawings.

BEST MODE FOR CARRYING OUT THE INVENTION

Embodiments of the present invention will be described in detail below with reference to the accompany drawings.

Note that the term "printing" used herein refers not only to forming an image having significant information such as letters and figures but also forming a wide variety of images, designs, and patterns on a printing medium regardless of the presence or absence of significant meaning and regardless of the possibility of visual detection by a human eye, or refers to processing the printing medium.

The term "printing medium" refers to not only a paper sheet generally used in a printing apparatus but also a wide variety of substances acceptable of ink such as cloth, plastic, film, metal plate, glass, ceramics, wood, and skin. However, hereinafter, the printing medium will be referred to as "paper sheet" or simply as "paper".

As a liquid used in a liquid supply system of the present invention, ink is used as an example in the following embodiments. However, an applicable liquid is not limited to ink. Needless to say, a processing liquid to a printing medium is included in the field of inkjet printing.

First Embodiment

Figure 1:
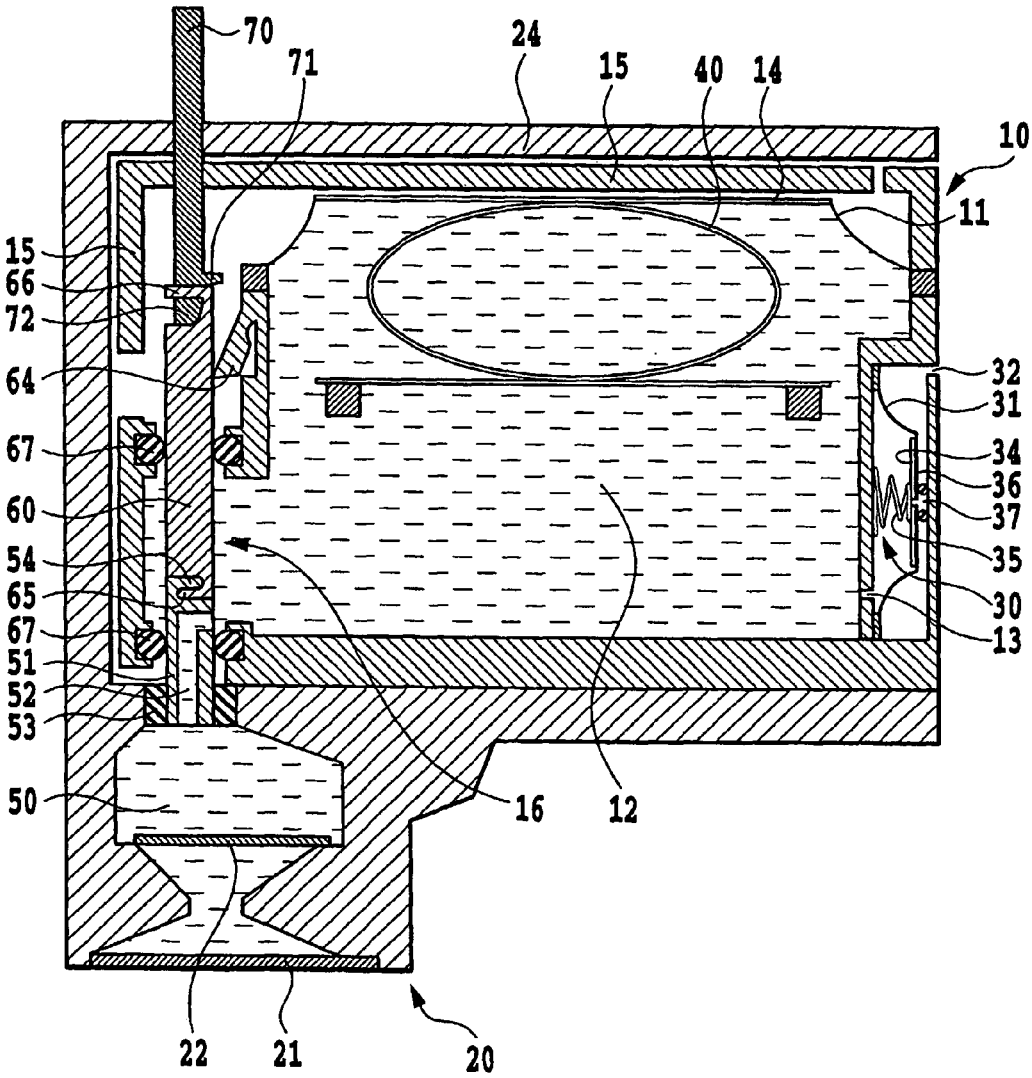
FIG. 1 is a schematic sectional view showing the state in which an ink tank is attach to a printing head, according to a first embodiment of the present invention.
Figure 2A:
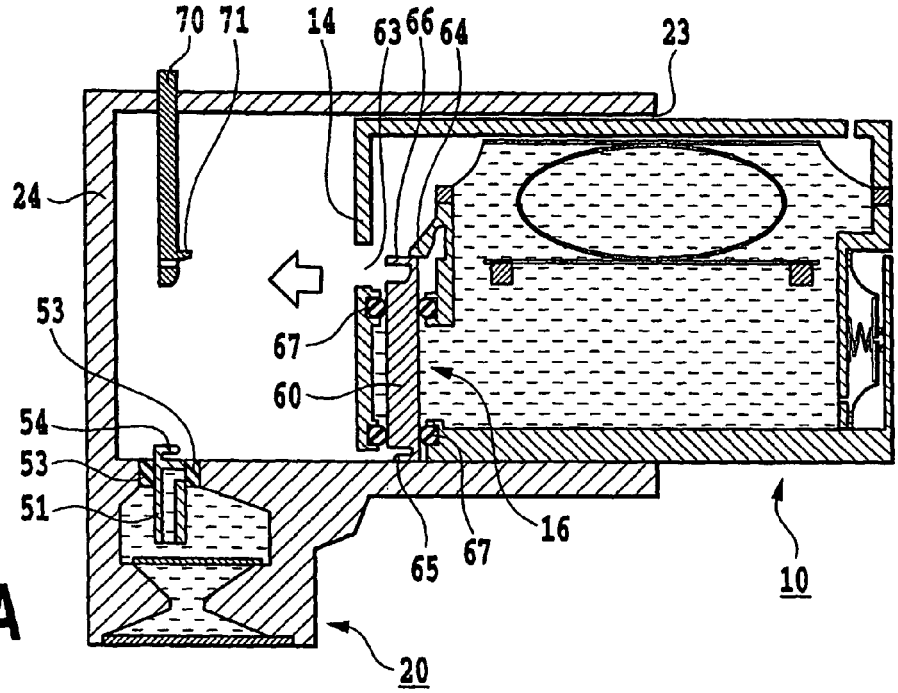
FIGS. 2A and 2B are schematic sectional views showing a process for installing the ink tank in the printing head according to the first embodiment.
Figure 2B:
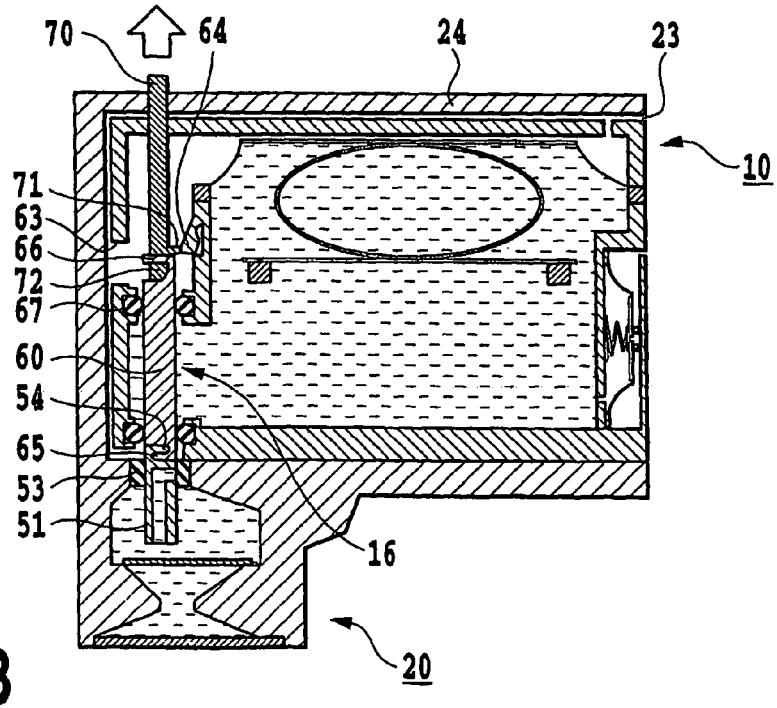
Figure 3:
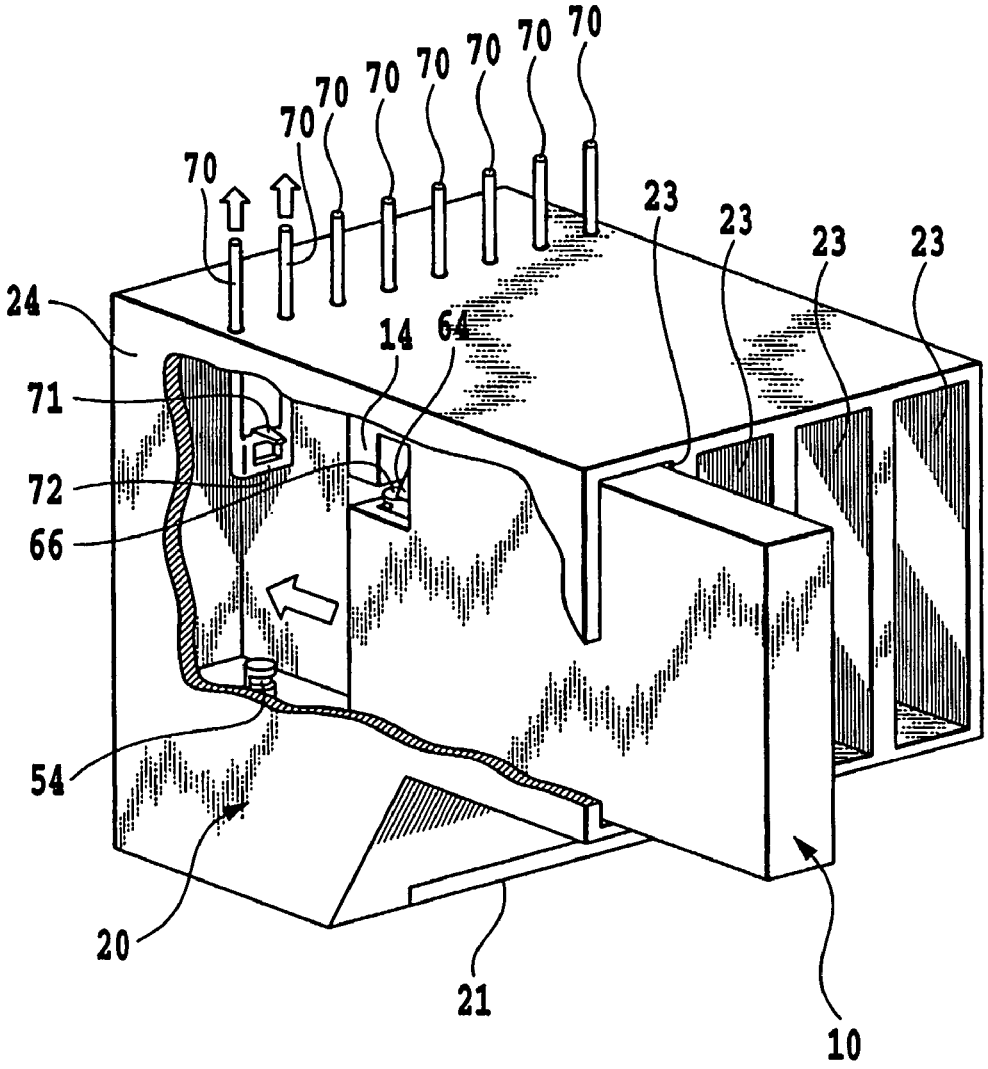
FIG. 3 is a perspective view showing a process for installing the ink tank in the printing head according to the first embodiment.

The mechanism for attaching and removing of an ink tank to and from a printing head will be explained with reference to FIGS. 1, 2A, 2B and 3. FIG. 1 is a schematic sectional view showing the state (hereinafter sometimes referred to as a "attached state") where the ink tank is attached to the printing head. FIGS. 2A and 2B are schematic sectional views showing a process for attaching the ink tank to the printing head. FIG. 3 is a perspective view showing the attaching process shown in FIG. 2A where a side of a printing head 20 is partially cut away for the sake of explanation.

In the attached state shown in FIG. 1, ink is supplied from an ink tank 10 serving as a liquid storage container to an inkjet printing head 20 (hereinafter simply referred to as a "printing head"). More specifically, for an ink storage chamber 12 of the ink tank 10 of this attached state, a moving member 60 provided in the ink tank is engaged with a communication pipe 51 of the printing head; at the same time, an operation member 70 provided in the installation section of the ink tank moves above, thereby the communication pipe 51 is made a pulled up state. In this state, a communication channel 52, which is a hollow portion of the communication pipe 51, comes into communication with the ink storage chamber 12. More specifically, through an ink lead chamber 16 formed continuously to the ink storage chamber 12 and shown at the left handed side of the figure, the moving member 60 and the communication pipe 51 engaged with the member 60 are passed in a vertical direction. The surface around such cylindrical members 60 and pipe 51, O rings 67 are arranged in contact therewith. By these O ring arrangements, the ink lead chamber 16 is closed airtight against the exterior portion of the ink tank, except for a portion at which the communication channel 52 of the communication pipe 51 is communicated with the ink lead chamber 16. The communication channel 52 of the communication pipe 51 is also communicated with a liquid chamber 50 of the printing head 20. The liquid chamber 50 is further communicated, via a filter 22, with ink channels corresponding to ink ejecting orifices of the ink ejection section 21, respectively.

FIG. 2A is a view showing the state where the ink tank 10 is being inserted in the ink tank installation section, which is integrally formed with the printing head 20, in order to attach the ink tank 10 to the printing head 20. FIG. 3 is a perspective view showing this state. As shown in these figures, the ink tank 10 is prepared for each ink color and inserted into each of the tank installation ports 23. The direction of this insertion is perpendicular to the direction of ink ejected from the printing head 20. As is explained later in the section describing the printing apparatus shown in FIG. 7, the ink tank 10 is horizontally inserted from the front of the printing apparatus. In addition, the insertion of ink tank is made by sliding it along the bottom of the installation section, on which the ink tank is placed in the attached state. By this configuration, the ink tank 10 can be attached to the printing head 20 without providing any special guide member and with no positional deviation of the ink tank in the height direction. Furthermore, the position of the ink tank in a perpendicular direction to the plane of the drawing of FIG. 2A (that is, the direction perpendicular to the height direction) can be made by use of side walls partitioning the tank inserting port 23. The positioning operations in the up-and-down direction and the perpendicular direction thereto may be performed accurately enough to engage the engagement sections of the moving member 60, the communication pipe 51, and the operation member 70 with each other as described later. For example, the widths of the engagement portions of individual members are made widen so that these members can be engaged even if the insertion position of the ink tank is deviated to some extent from a desired position. Thereby, the accuracy of the ink tank in insertion position is not particularly required. In either case, the positioning accuracy of the ink tank in the height direction becomes relatively high by inserting the ink tank by use of the bottom of the installation section.

In the ink lead chamber 16 of the ink tank 10, the cylindrical moving member 60 is vertically passed through almost the center of the chamber. The O rings arranged on the both sides of the ink lead chamber 16 are in contact with the peripheral surface of the moving member 60. By this configuration, the moving member 60 can move up and down while sealing the ink lead chamber 16 and ink storage chamber 12 continuously formed with the chamber 16 airtight against the exterior. The end portion of the moving member 60 protruding upward from the ink lead chamber 16 is provided with an engagement section 66 for engaging with an engagement section of the operation member 70. On the other hand, the end portion of the moving member 60 protruding downward from the ink lead chamber 16 is similarly provided with an engagement section for engaging with an engagement section of the communication pipe 51 of the printing head.

The moving member 60 can maintain its position by friction force working between the O rings 67 and the member 60. Therefore, when the ink tank 10 is not attached to the printing head 20, the position of the moving member 60 can be maintained by the friction force as shown in FIG. 2A, thereby preventing ink leakage from the ink lead chamber 16. The moving member 60 is maintained at a position where the lower end portion thereof, that is, the engagement section 65, does not downwardly protrude from the lower side surface of an outer case 15 of the ink tank 10. By this arrangement, the moving member 60 successfully avoids to, even partly, be in contact with the bottom of the tank inserting portion 23 when the ink tank 10 is inserted in the installing section. The moving member 60 is therefore designed not inhibit installation of the ink tank. Note that a stopper section 64 is provided above the moving member 60. The stopper section 64 prevents the moving member 60 from accidentally moving up by fall or vibration during distribution time when the ink tank is not installed. At the time the ink tank is installed, the stopper section 64 is pressed by the engagement section of the operation member 70 and elastically distorted, thereby releasing the moving-up prohibition action of the moving member 60.

In the printing head 20 side, the operation member 70 is provided which is connected to a motor of the printing apparatus and is movable in the height direction. The operation member 70 has a U-shape form as shown in FIG. 3 and provided in each installation section of the ink tank of every color ink. The linear portions of the operation member 70 pass through holes provided in the upper surface of a frame 24 of the printing head 20 and extend upward. Each of the holes is provided at a position which allows the linear portion to engage with moving member of the ink tank 10 when the ink tank is inserted up to the installation position. More specifically, as shown in FIG. 2B, each hole is provided at a position which allows the engagement section 71 of the operation member 70 to come into contact with the stopper 64 of the ink tank, thereby pressing the stopper when the ink tank is installed; at the same time, engagement sections 66 and 65 of the upper and lower ends of the moving member 60 can be engaged respectively with an engagement hole 72 of the operation member 70 and an engagement section 54 of the communication pipe 51 of the printing head.

The communication pipe 51 of the printing head 20 is a tubular-form member similar to the moving member 60. The communication pipe 51 maintains its position by virtue of friction force working between the member 60 and sealing members 53 serving similarly to the O rings. Since the peripheral surface of the communication pipe 51 is in close contact with the sealing members 53, the printing head can be sealed against the exterior.

In the state where the ink tank is not installed, as shown in FIG. 2A, only the upper engagement section 54 of the communication pipe 51 is allowed to protrude from the bottom of the tank inserting port 23. At this time, the peripheral surface of the communication pipe 51 and the hollow portion thereof, that is, the opening of the communication channel 52, are covered with sealing members 53, with the result that the interior of the printing head such as the liquid chamber 50 can be sealed airtight against the exterior except for the an ink ejection section 21.

FIG. 2B shows the state where the ink tank 10 is inserted in the direction indicated by the arrow shown in FIG. 2A until the tank 10 is stopped by engaging with the engagement section of a member such as the operation member 70. Note that, in this case, the ink tank is stopped by bringing the communication pipe 51 into contact with the moving member 60 or bringing the moving member 60 into contact with the operation member 70. However, the ink tank may be positioned by striking the ink tank against a striking member (not shown) provided within the printing head 20.

In this state, the engagement section 54 of the communication pipe 51 is engaged with the engagement section 65 of the moving member. Also, the engagement hole 72 of the operation member 70 is engaged with the engagement section 66 of the moving member 60. When the engagement section 71 of the operation member 70 for releasing a stopper comes into contact with the stopper section 64 of the ink tank 10, elastic distortion occurs, thereby releasing the stopper. In this manner, the moving member 64 becomes ready to move.

In the above state, the operation member 70 is moved in the direction indicated by the arrow shown in FIG. 2B; thereby moving the moving member 60 and the communication pipe 51 connected thereto by means of mutual engagement sections. Note that it is desirable to move the moving member 60 in this manner after detecting that the ink tank 10 is located at a predetermined position based on the presence or absence of electrical contact. When the position of the ink tank is determined not proper by the detection, alarm can be given in order to instruct the user to insert the tank properly. The operation member 70 can be moved by driving force of a motor (not shown) and a transfer member for transferring the driving force. A known mechanism can be used as long as it can convert rotation driving force of the motor into linear movement. The operation members 70 of tanks for individual colors are configured so as to move separately from each other.

FIG. 1 shows the state where the operation member 70 is completed movement, that is, the attaching of the ink tank 10 to the printing head 20 is completed. When the operation member 70 moves, the moving member 60 moves upward; at the same time, the communication pipe 51 enters the ink lead chamber 16, and the communication channel 52 of the communication pipe 51 comes into communication with the ink lead chamber 16 through its opening. In this manner, the ink lead chamber 16, that is, the ink storage chamber 12 is communicated with the liquid chamber 50 of the printing head 20. The operation member 70 desirably moves until the opening of the communication channel 52 is placed at the ink lead chamber side from the portion sealed with the sealing member 53 and the opening is placed evenly to the lowermost surface of the ink storage chamber 12. This is because if the opening of the communication channel 52 is placed higher than the lowermost surface of the ink storage chamber 12, ink will be left in the ink storage chamber 12.

The lower O rings 67 provided for the moving member 60 make sealing by coming into contact with the moving member 60 before the ink tank is inserted; however, make sealing by coming into contact with the communication pipe 51 when the ink tank is attached. For this reason, it is desirable that the moving member 60 and the communication pipe 51 have the same outer diameter. Furthermore, when the operation member 70 is moved after the position of the ink tank 10 is detected; it is possible to avoid inserting the communication pipe having positional deviation. As a result, an unnecessary load is not applied to the communication pipe, so that durability of the communication pipe can be ensured even if it is repeatedly installed. Moreover, since the communication pipe 51 is supported by the sealing member 53 formed of an elastic material, which is tolerable for positional deviation more or less. During the movement time of the operation member 70, the ink tank 10 is movable to some extent. Therefore, the ink tank can automatically move to a right position by elastic repulsion of the communication-pipe sealing member 53. The moving operation may be performed at any time during the interval from immediately after the user inserts the ink tank until printing is actually initiated.

The ink tank 10 can be removed from the installation position shown in FIG. 1 in the reversal operation to that mentioned above. To explain more specifically, the operation member 70 is moved downward to a predetermined amount up to the position shown in FIG. 2B. The user removes the ink tank from the installation position from this state. In this way, the ink tank can be removed.

Next, in the configuration mentioned above, the structure of the ink storage chamber 12 and a mechanism for supplying ink including the operation of the ink storage chamber 12 will be explained.

As shown in FIG. 1, the ink tank 10 is roughly formed of two chambers: the ink storage chamber 12 including the ink lead chamber 16, which serves as a space for storing ink, and a valve chamber 30. The interiors of them are communicated with each other by way of a communication channel 13. Ink to be ejected from the printing head is stored in the ink storage chamber 12 and supplied to the printing head in accordance with an ejection operation.

The upper portion of the ink storage chamber 12 is partitioned by a member integrally formed of a deformable flexible film (sheet member) 11 and a pressure board 14. The space between the upper member and the outer case 15 of the ink tank, communicates with the air. The interior of the ink storage space 12 is a space substantially closed air tight, except for a portion in communication with the printing head by way of the communication pipe 51 of the printing head 20 and the communication channel 13 with the valve chamber 30. Furthermore, the air is introduced into the ink storage chamber 12 by way of the valve chamber 30 depending upon the pressure state thereof and stored in the upper portion of the storage chamber 12.

The center portion of the sheet member 11 is formed of a plate-form supporting member, namely, the pressure board 14, which restricts the shape thereof. The peripheral portion thereof is deformable. The sheet member 11 integrally formed with the pressure board has almost a trapezoid sectional view with a convex form at the center previously formed. The sheet member 11 deforms depending upon the amount of ink and pressure change of the ink storage space 12, as described later. When deformed, the peripheral portion of the sheet member 11 expands or shrinks in a balanced manner, and the center portion of the sheet member 11 moves in the vertical direction of the plane of the figure while maintaining virtually a horizontal posture. Since the sheet member 11 thus deforms (moves) smoothly, no impact is produced by the distortion, with the result that abnormal pressure change does not occur in the ink storage space due to the impact.

In the ink storage space 12, a spring member 40 is provided to press the sheet member 11 via the pressure board 14 upward in the figure. The press force produces a negative pressure capable of ejecting ink from the printing head while keeping a balance with a force maintaining a meniscus formed in the ink ejection portion of the printing head. When the volume of the air remaining in the ink storage chamber 12 is varied by environmental change (ambient temperature and air pressure), the variation can be compensated by the displacement of the spring 40 and the sheet 11 so as not drastically change the negative pressure within the chamber. Note that FIG. 1 shows the state where the ink storage space 12 is nearly completely filled with ink with substantially no air therein. The spring 40 in this state is compressed, producing an appropriate negative pressure in the ink storage space.

The valve chamber 30 has a one-way valve for introducing a gas (the air) from outside, preventing ink leakage from the ink tank 10, when the negative pressure of the ink tank 10 increases beyond a predetermined value. The one-way valve has a pressure board 34 serving as a valve-closing member having an aperture, sealing members 36 fixed at a position facing a communication portion 37 of an inner wall of the case of the valve chamber and sealing the communication portion 37, and a sheet member 31, which is connected to the pressure board and in which the aperture is formed. The valve chamber 30 is also virtually kept airtight except for the communication port 13 communicated with the ink tank 10 and the communication portion 37 communicated with the air. The space within the case of the valve chamber at the right hand side of the figure from the sheet member 31 is open to the air by way of an air communication port 32 and has the same pressure as that of the air. The peripheral portion of the sheet member 31 is deformable except for the portion connected to the pressure board 34 in the center. The sheet member has a convex portion at the center portion and looks a trapezoid as viewed from the side. By virtue of such a configuration, the pressurizing board 34 serving as a valve-closing member can be smoothly moved to the right and left sides.

Within the valve chamber 30, a spring member 35 is provided as a valve controlling member for controlling open/close motion of the valve. The spring member 35 is also arranged at a slightly compressed state from the beginning. By use of the reaction force of the compression, the pressurizing board 34 is pressed toward the right side of the figure. When the spring member 35 is expanded or compressed, the sealing member 36 seals and unseals the communication portion 37, thereby serving as a valve. Furthermore, the valve serves as a one-way valve which allows introduction of the air into the valve chamber 30 from the air communication port 32 through the communication portion 37.

As the sealing member 36, any material may be used as long as the communication portion 37 can be closed airtight. More specifically, the a member capable of forming a plane with the circumference surface of the opening when it comes into contact with the communication portion 37, a member having an adhesive rib around the communication portion 37, or a member having a blockage form such as a tip which can be inserted into the communication portion 37 to block it, may be used as the sealing member 36. Likewise, the sealing member may have any form as long as an airtight state is maintained. The material of the sealing member is not particularly limited. Since airtight closure is attained by expansion force of the spring member 35, it is more preferable that the seal member is formed of a material, such as an elastic material like rubber, having contractibility movable in accordance with movement of the seat member 31 and the pressurizing plate 34.

As to the structure of the ink tank 10, individual portions are designed to satisfy the following conditions. With consumption of ink, the initial state of the tank filled with ink changes to the state where the negative pressure of the ink storage chamber 12 is balanced with the force applied by the valve control member of the valve chamber 30. When a negative pressure further increases form this state, the communication portion 37 is opened to introduce the air into the ink storage space. Since the sheet member 11 and the pressure board 14 are capable of displacing upward, the volume of the ink storage chamber 12 is increased by introduction of air, conversely. Since the negative pressure decreases simultaneously, the communication portion 37 is closed.

Furthermore, even if the surrounding conditions of the ink tank change, for example, even if temperature elevation or pressure reduction take place, the air contained in the storage space is allowed to expand by the volume corresponding to the difference in volume between the initial state and the lowermost displacement state of the sheet member 11 and the pressurizing board 14. In other words, since the space having such a volume works as a buffer region, a pressure increased by change of the peripheral environment can be cancelled off. In this manner, leakage of ink from the ejection port can be efficiently prevented.

With ejection of ink from the initial charge state, the inner volume of the ink storage space decreases. However, since the outer air is not introduced until a buffer region is formed, leakage of ink will rarely occur even if rapid peripheral environment change, vibration and fall, take place by that time. Furthermore, since the buffer region is not formed before ink is used, volume efficiency of the ink container is high. Therefore, a compact structure can be ensured.

Note that the example shown in the figure, the spring 40 of the ink storage chamber 12 and the spring 35 of the valve chamber 30 are shown in the form of coil. However, it goes without saying that a spring of other form can be used. For example, a conical coil spring and a plate spring may be used. When the plate spring is used, a pair of plate spring members having a U-letter section may be used in a state that opening ends thereof are allowed to face each other.

An ink supply route in the liquid chamber 50 of the printing head 20 has a section whose width gradually increases from the portion (upstream) attached to the ink tank 10 and then gradually decreases toward the printing head 20 (downstream). The broadest portion of the ink supply route is provided with a filter 22, which prevents impurities contaminated in the supply ink from entering the ejection section 21.

The ejection section 21 of the printing head 20 has a plurality of ejection ports, which are arranged in a predetermined direction (however, in the case of a serial printing system in which a printing head is mounted on a carriage and ejects ink while moving relative to a printing medium, the direction differs from the moving direction of the carriage); ink channels communicating with the ejection ports; and a device arranged in the ink channel and used for generating energy for ejecting ink. The system of ejecting ink of the printing head, that is, the form of a device for generating energy, is not particularly limited. For example, an electro-thermal converter which generates heat with application of power may be used as the device and its thermal energy generated from the device may be used for ejecting ink. In this case, heat generated from the electro-thermal converter is applied to ink to generate film boiling and its foaming energy is used for ejecting ink from the ink ejection port. Alternatively, use may be made of an electromechanical converter such as a piezo element, which deforms in accordance with application of voltage. In this case, ink is ejected by use of mechanical energy.

Note that the ejection section 21 and the liquid chamber 50 of the printing head 20 may be detachably or non-detachably formed as an integrated form. Alternatively, the ejection section 21 and the liquid chamber 50 of the printing head 20 discretely formed are connected by way of a communication route. As the integrated from, a cartridge form, which detachably loaded on a carrier member (e.g., carriage) of the printing apparatus.

As is explained in the above, a feature of this embodiment resides in that the moving member 60, which is arranged in the ink tank 10, moves up the communication pipe 51 to introduce it within the ink tank for supplying ink. In this mechanism, the ink tank, which is responsible for leading ink from the bottom, can be installed by the operation in the horizontal direction. As a result, the space size for attaching and removing the ink tank can be regulated correspondingly to the widthwise length. The space size can be decreased compared to a conventional case where an ink tank is attached and removed from the above. Furthermore, since the user can install the ink tank along the bottom surface of the ink tank installing section, the positional accuracy of the ink tank in the height direction improves. The positional accuracy is sufficient as long as engagement portions are engaged with each other, that is, it is not necessary to increase the accuracy of the ink tank installing section itself.

Furthermore, in the state where the communication pipe is introduced in the ink tank by moving the operation member, even if the moving member and the communication pipe are not aligned accurately, the axis centers are agreed with each other by virtue of repulsion of the elastic member, thereby correcting the positional deviation. Moreover, the liquid chamber, when the tank is not attached, can be maintained airtight without using complicated parts and structure, with the result that reduction of the ink supply performance due to solidification and vaporization of ink can be prevented. In addition, after the position of the tank is detected, the operation for communicating ink is performed. Therefore, the load of the communication pipe can be reduced, improving the durability thereof. From the points mentioned above, it is possible to reduce the user's operational load and improve operationality.

Second Embodiment

Figure 4:
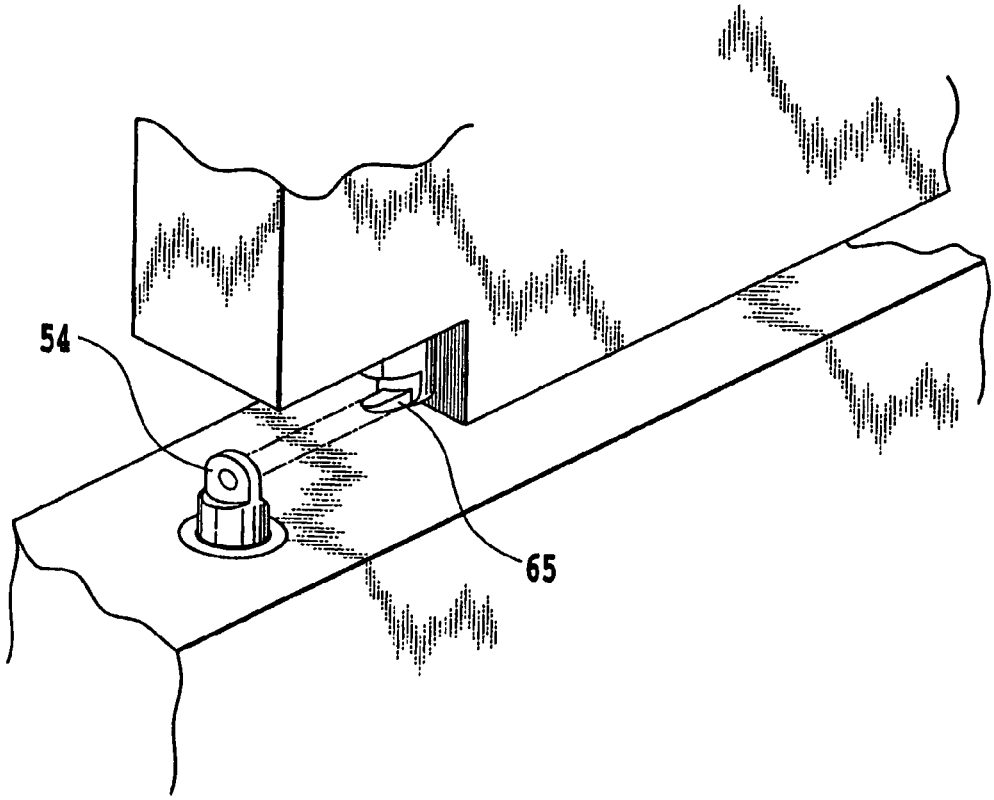
FIG. 4 is an enlarged perspective view showing the connection section between a moving member of an ink tank and a communication pipe of a printing head according to a second embodiment of the present invention.

FIG. 4 is a perspective view showing modifications of the engagement section 54 of the communication pipe 51 and the engagement section 65 of the moving member 60 are modified.

In the first embodiment, the engagement section 54 of the communication pipe and the engagement section 65 of the moving member have wedge shapes symmetric with each other. However, as shown in FIG. 4, the engagement section 54 of the communication pipe may have a through-hole and the engagement section 65 of the moving member has a projection to be engaged with the through-hole. In the case where the communication pipe 51 and the moving member having the above configuration are engaged with each other, the movable region of each of the communication pipe 51 and the moving member is enlarged, meaning that the communication pipe 51 can be introduced smoothly into the ink storage chamber 12.

Furthermore, since the engagement section 54 of the communication pipe is introduced into the ink tank and dipped in ink, the ink still remains and solidifies at the engagement section 54 when the ink tank is removed. However, in this embodiment, the solidified matter can be eliminated by the presence of the projection of the engagement section 65 of the moving member and engagement can be ensured.

Third Embodiment

Figure 5A:
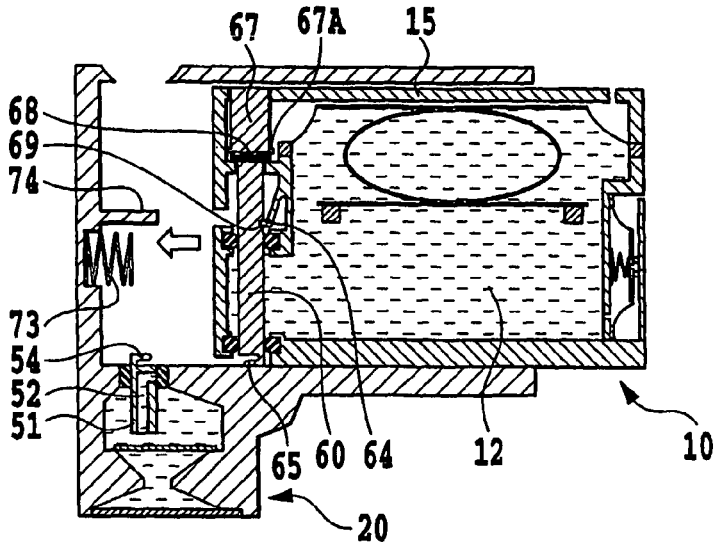
FIGS. 5A to 5C are schematic sectional views showing a process for installing an ink tank in a printing head according to a third embodiment of the present invention.
Figure 5B:
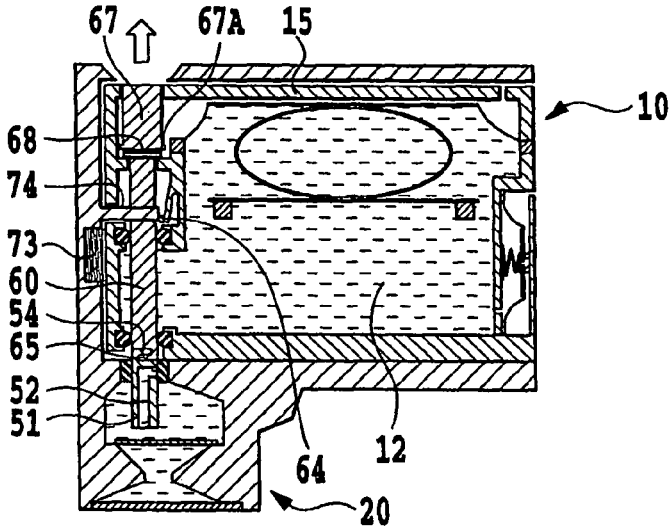
Figure 5C:
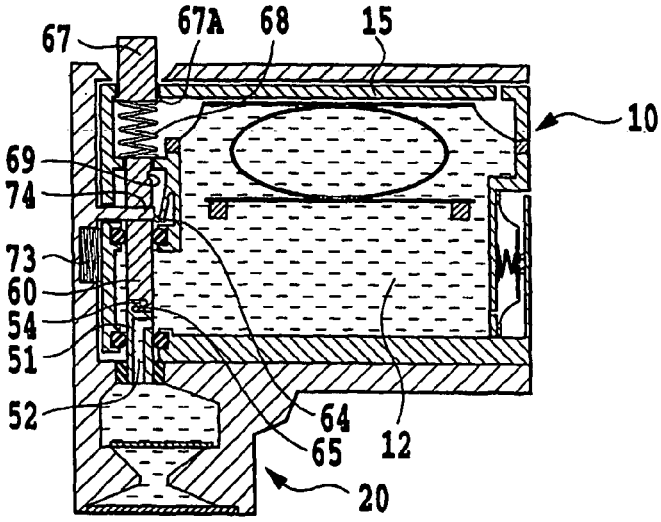

FIGS. 5A to 5C are section views illustrating the structure for moving the moving member and the communication pipe according to a third embodiment of the present invention. In this embodiment, the moving member 60 and the communication pipe 51 can be moved not by driven force of the printing apparatus (motor) but by a spring arranged within the ink tank.

FIG. 5A is a view showing the state where the ink tank 10 is being inserted along the bottom surface of the tank insertion port 23 in order to attach the ink tank 10 to the printing head 20.

In this figure, a releasing portion 74 for releasing the stopper 64 of the ink tank 10 is fixed integrally with the printing head 20 above the stopper. On the other hand, the moving member 60 of the ink tank 10 has an engagement section 69 partially cut away to be engaged with the stopper 64, and is limited from moving upward. With the insertion of the ink tank 10, the moving member 60 of the ink tank 10 comes closer to the releasing portion 74 of the printing head. However, the stopper releasing portion 74, which is formed of a U-letter having two linear arms, comes into contact with the stopper section 64 at the linear arms without being contact with the moving member 60 by the presence of a recess portion of the U-letter. Note that during the insertion, the ink tank 10 is inserted while pressing the spring 73 by the outer case.

When the ink tank is inserted, the stopper 64 strikes the releasing section 74 and deforms, as shown in FIG. 5B. In this manner, the engagement between the stopper 64 and the engagement section 69 of the moving member 60 is released to allow the moving member 60 to move upward. At that time, since the portion of the outer case 15 of the ink tank 10 corresponding to the moving member 60 is open, the moving member 60 can move in the direction (upward) indicated by the arrow by the force of the spring 68. Since the engagement section 65 of the moving member 60 is engaged with the engagement section 54 of the communication pipe 51 in the same manner as in the first embodiment, the communication pipe 51 moves in accordance with the movement of the moving member 60 and enters into the ink tank.

In this state, a tank-removing spring 73 is compressed and presses the ink tank 10 in the direction of removing it. However, the moving member 60 has already moved up and passed through the opening of the outer case 15 as described above. Therefore, the ink tank 10 is prevented from moving. Note that the spring 73 is provided for improving the operation of exchanging the tank, more specifically, for sliding the ink tank. The spring 73 is not an essential member in the configuration according to the present invention. Large force is not required for sliding the tank if the friction force between the ink tank and the bottom surface of the tank insertion port is suppressed low. A spring having lower elastic force may be used.

FIG. 5C is a view showing the state where the moving member is completed moving from the state of FIG. 5B, more specifically, the state where the attaching of the ink tank 10 to the printing head 20 is completed. On the upper end of the moving member 60, a tank removal operation section 67 is mounted and a ring-form stopper 67A is attached to the lower end thereof. The stopper 67A of the moving member 60 comes into contact with the lower surface of the outer case 15 of the ink tank at the state where the opening portion of the communication channel 52 of the communication pipe 51 is communicated with the ink storage chamber 12. In this manner, the moving member 60 is stopped from moving upward. At this time, the tank-removing operation portion 67 protrudes from the opening portion of the ceiling board of the printing head 20.

When an ink tank 10 is exchanged with a new one, the user presses the tank removing operation portion 67 until the top portion of the section 67 comes below the lower surface of the outer case 15. Following that, the tank 10 can be pushed out from the installation section by the force of the tank removing spring 73.

As described above, in the present embodiment, a communication operation can be automatically performed by operational springs provided within the ink tank. Therefore, no driving motor force is required, thereby reducing the number of parts for use in the printing apparatus.

Fourth Embodiment

Figure 6:
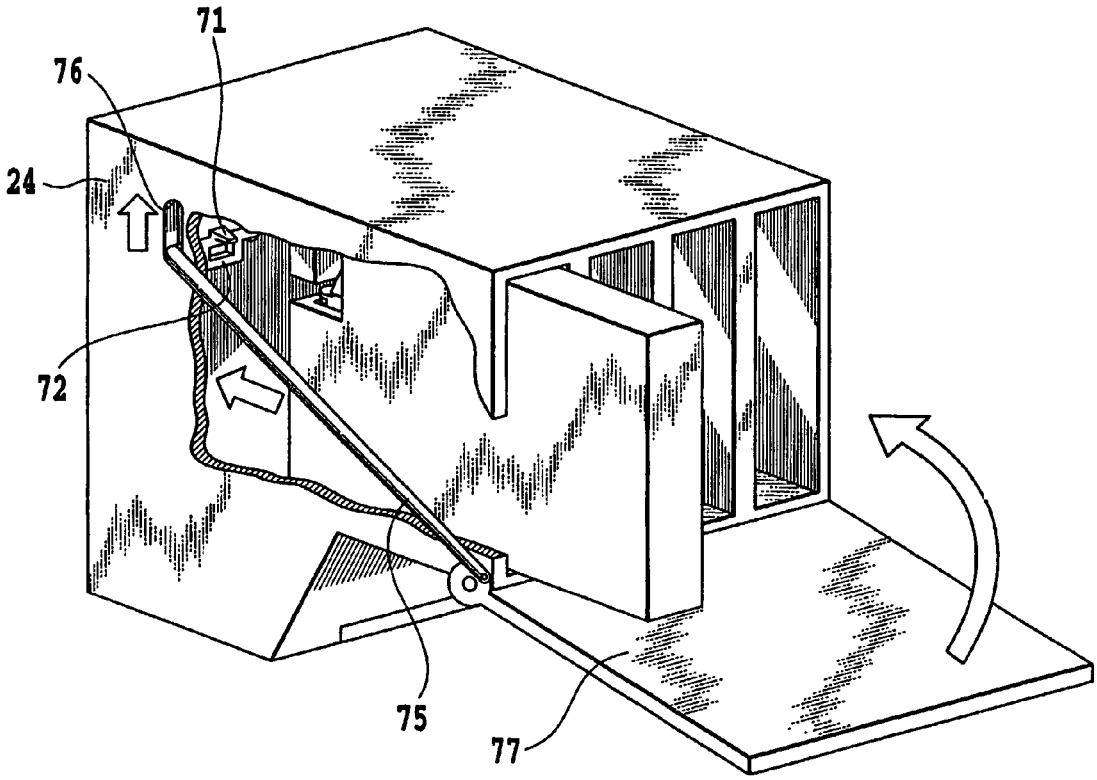
FIG. 6 is a perspective view showing the process for installing an ink tank in a printing head according to a fourth embodiment of the present invention.

FIG. 6 is a perspective view illustrating the moving mechanism of a communication pipe according to a fourth embodiment of the present invention. In this embodiment, the cover of the insertion port of the ink tank installing section is used to move the communication pipe.

As shown in FIG. 6, in this embodiment, a cover 77 is provided to an ink tank installing section integrally formed with the printing head in order to cover the insertion port for the ink tank. The cover 77 can be rotated about a portion near the lower end portion of the tank inserting port as a rotation axis. Insertion ports of individual color ink tanks can be covered by a single cover. The rotation axis of the cover 77 is equipped with a cam member which can rotate about the axis. To the cam member, one end of a shaft 75 formed of a high rigid material is connected to a portion remote from the center of the rotation axis. The shaft 75 is rotatably connected to the cam member, to allow the movement of the cam as will be described later. The other end of the shaft 75 extends into an ink tank installing section through a slide groove 76 provided in a side surface of the frame 24 of the printing head 20. The shaft 75 extends through the ink tank installing section for installing individual ink colors and the end is slidably connected to the frame 24 so as to move in concert with the movement of the cam. Simultaneously, the shaft 75 has engagement sections 71 and engagement holes 72 corresponding to individual ink color tanks in the portion across the tanks in the same manner as in the operation member 70 shown in FIG. 3. In this mechanism, it is possible to move the moving member 60 and the communication pipe 51 engaged with the moving member 60 in the same manner as in the first embodiment mentioned above. More specifically, as shown in FIG. 6, when the ink tank is inserted, the engagement section 71 of the shaft 75 releases the engagement of the stopper 64 with the moving member 60 and allows the engagement of the engagement section 65 of the moving member 60 with the engagement hole 72 of the shaft 75.

Other ink tanks are inserted in the same manner. After all ink tanks are inserted, the cover 77 of the tank insertion port is rotated to close the tank insertion port. The shaft 75 moves up along the slide guide 76 by moving the cam in accordance with the rotation of the cover in concert with the slide groove 76. By the movement, the movable member 60 and the communication pipe 51 in engagement with the member 60 move in the same manner as in the first embodiment, with the result that the printing head comes into communication with the ink tank.

According to this Embodiment, a plurality of tanks are all communicated with the printing head at the same time.

Therefore, parts involved in the communication operation can be used in common. Therefore, the number of parts can be reduced most than ever. In addition, by performing the open/close operation of the cover of the tank insertion port in association with the communication operation, the communication operation can be completed without fail.

Other Embodiments

Embodiments regarding the configuration of the ink tank connection, basically ink is not held by an absorber but stored or supplied as it is. On the other hand, a movable member (sheet member, pressure board) and a spring member for pressing the movable member are employed as negative pressure generating means. At the same time, the supply system is formed airtight. In this manner, a negative pressure is appropriately applied on the printing head. This configuration makes it possible to increase volume efficiency and improve the freedom of ink selection, compared to a conventional technique in which a negative pressure is generated by an absorber. However, the configuration of the ink tank according to the present invention should not be limited to this. To explain more specifically, the ink tank is connected in any manner as long as the communication pipe is introduced into the ink tank and the ink tank and the printing head can be communicated with each other, no matter what inner structure the ink tank has. This means that the ink tanks may have an absorber for generating a negative pressure due to the capillary action.

As a printing system of the embodiments mentioned above, a serial type inkjet printing apparatus has been explained. However, application of the present invent is not limited to this system. For example, the present invent is applicable even to a printing apparatus using a full line type printing head. It goes without saying that a plurality of liquid supply systems may be provided depending upon color tones (color, concentration) of ink.

Furthermore, in the above, the cases where the present invention is applied to an ink tank for supplying ink to a printing head are explained. However, the present invent is applicable to a supply unit where ink is supplied to a pen as a printing means. Moreover, other than such various printing apparatuses, the present invention is applicable to apparatuses for supplying various types of liquids such as drinking water and liquid flavoring materials, or to a wide variety of fields including the medical field for supplying medicals.

The Structure of Inkjet Printing Apparatus

Figure 7:
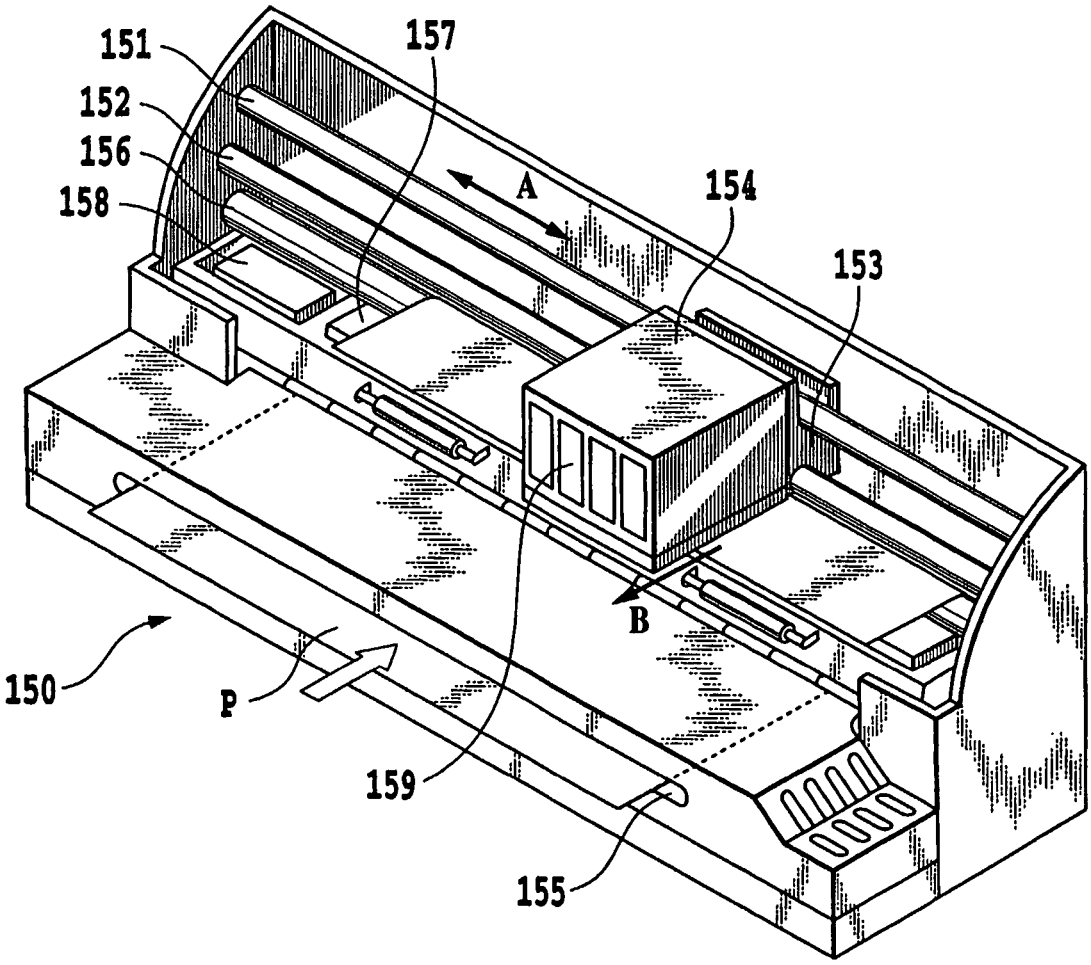
FIG. 7 is a perspective view showing an inkjet printing apparatus according to an embodiment of the present invention.

FIG. 7 is a view illustrating a structure of an inkjet printing apparatus to which a configuration of attaching an ink tank to a printing head according to any one of the embodiments can be applied.

A printing apparatus 150 of the embodiment is a serial scanning type inkjet printing apparatus. A carriage 153 is movably guided in a main scanning direction indicated by arrow A by guiding shafts 151 and 153. The carriage 153 can be reciprocally moved in the main scanning direction by a carriage motor and a driving force transferring mechanism such as a belt for transferring the driving force. On the carriage 153, a printing head and an ink tank employed in any one of embodiments are mounted. A paper sheet P serving as a printing medium is fed through an insertion port 155 provided in the front portion of the apparatus, reversed in feed direction on the way, and then, fed by a feed roller 156 in a sub scanning direction indicated by arrow B. The printing apparatus 150 prints (prints) images on the paper sheet P one after another by repeating a printing operation in which ink is ejected onto the printing region of the paper sheet P on a platen 157 while moving the printing head in the main scanning direction, and a feed operation in which the paper P is fed in the sub scanning direction by the distance corresponding to the printing width.

Note that the printing head uses heat energy generated from an electro-thermal converter as energy for ejecting ink as mentioned above. In this case, heat generated from the electro-thermal converter is applied to ink to generate film boiling and its foaming energy is used for ejecting ink from the ink ejection port. Furthermore, the ink ejection system from a printing head is not limited only to that using an electro-thermal converter, and, for example, a system for ejecting ink by use of a piezo element may be employed.

At the left hand side of the moving region of the carriage 153 in the figure, a recovery system unit 158 is provided so as to face the ink ejection port formation surface of the printing head mounted on the carriage 153. The recovery system unit 158 is provided with a cap for covering the ink ejection ports of the printing head and a suction pomp for introducing a negative pressure into the cap. By introducing a negative pressure into the cap covering the ink ejection ports, it is possible to withdraw ink form the ink ejection ports. In this manner, a recovery operation can be performed in order to keep good ink ejection state of the printing head. Alternatively, a recovery treatment (preliminary ejection operation) for maintaining good ink ejection state may be performed by ejecting ink from the ink ejection port within the cap, separately from the image formation.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2004-169110 filed Jun. 7, 2004, filed which is hereby incorporated by reference herein.

The invention claimed is:

1. An ink tank arranged vertically above a printing head when in use in a printing apparatus, and capable of attaching and removal operations for being attached to and removed from a tank mount portion through which said ink tank is connected to the printing head, said ink tank comprising:

a moving member for engaging with a communication member having a communication channel communicating with the printing head, wherein said moving member engages with the communication member in accordance with an attaching operation of said ink tank to the printing head, and wherein said moving member is moved upward in accordance with the attaching operation to guide the communication member into an ink storage portion of said ink tank.

2. An ink tank as claimed in claim 1, wherein said moving member is moved through the inside of the ink storage portion and an outside of the ink storage portion, and the inside of the ink storage portion is sealed with said moving member and a sealing member to be air tight to the out side.

3. An ink tank as claimed in claim 1, wherein said moving member includes a first engagement section for engaging with said communication member, at an end of said moving member, and a second engagement section for engaging with an operation member for transmitting driving force for a movement of said moving member, at the other end of said moving member.

4. An ink rank as claimed in claim 1, wherein said moving member and said communication member have generally cylindrical shape with approximately the same external diameter as each other.

5. An ink tank as claimed in claim 1, further comprising a stopper portion for limiting the upward movement of said moving member.

6. An ink tank as claimed in claim 5, further comprising an urging-force member for urging said moving member upward, and wherein the urging force of said urging-force member allows said engaged communication member to be guided into the ink storage portion, and said stopper portion limits the upward motion of said moving member when said ink tank is not attached to the printing head.

7. An ink tank as claimed in claim 1, wherein liquid ink is stored in the ink storage portion.

8. An ink tank according to claim 1, wherein the attaching operation of said ink tank is performed in a way that said ink tank slides along a bottom surface of the tank mount portion in a horizontal direction in the printing apparatus and is set in the tank mount portion.

9. A printing head for ejecting ink supplied from an ink tank arranged vertically above said printing head when in use in a printing apparatus, wherein said ink tank is capable of attaching and removal operations for being attached to and removed from a tank mount portion through which said ink tank is connected to the printing head, said printing head comprising:

a communication member for engaging with a moving member of the ink tank with an attaching operation of the ink tank to said printing head, and having a communication channel being guided into an ink storage portion of the ink tank being attached by the movement of the moving member, wherein said communication member is moved by said moving member in accordance with the attaching operation so as to communicate a liquid ink from the ink storage portion of the ink tank into said printing head.

10. A printing head according to claim 9, wherein the attaching operation of said ink tank is performed in a way that said ink tank slides along a bottom surface of the tank mount portion in a horizontal direction in the printing apparatus and is set in the tank mount portion.

11. An ink jet printing apparatus which includes a carriage for mounting a printing head and which uses the printing head for ejecting ink and an ink tank arranged vertically above the printing head when in use, and capable of attaching and removal operations for being attached to and removed from the printing head, and ejects ink to a printing medium, so as to perform printing, wherein the printing head includes a tank mount portion for attaching or removing the ink tank, said ink jet printing apparatus comprising:

a moving member for engaging with a communication member having a communication channel communicating with the printing head, wherein said moving member engages with the communication member in accordance with an attaching operation of said ink tank to the printing head, and wherein said moving member is moved upward in accordance with the attaching operation to guide the communication member into an ink storage portion of said ink tank.

12. An ink jet printing apparatus as claimed in claim 11, further comprising an insertion port cover capable of closing a insertion port for the ink tank when the ink tank is inserted for an attaching operation to the printing head, and wherein said moving member is moved in conjunction with a closing motion of the insertion port cover.

13. An ink jet printing apparatus according to claim 11, wherein the attaching operation of the ink tank is performed in a way that said ink tank slides along a bottom surface of the tank mount portion in a horizontal direction in the printing apparatus and is set in the tank mount portion.

14. A liquid storage container capable of attaching and removal operations for being attached to and removed from a liquid using device, the liquid using device including a mount portion for mounting said liquid storage container, said container comprising:

a moving member for engaging with a communication member having a communication channel communicating with the liquid using device, wherein said moving member engages with the communication member in accordance with an attaching operation of said liquid storage container to the liquid using device, and wherein said moving member is moved upward in accordance with the attaching operation to guide the communication member into a liquid storage portion of said liquid storage container.

15. A liquid storage container according to claim 14, wherein the attaching operation of said liquid storage container is performed in a way that said liquid storage container slides along a bottom surface of the mount portion in a horizontal direction in the liquid using device and is set in the mount portion.

* * * * *

UNITED STATES PATENT AND TRADEMARK OFFICE

CERTIFICATE OF CORRECTION

PATENT NO. : 7,290,861 B2
APPLICATION NO. : 10/563674
DATED : November 6, 2007
INVENTOR(S) : Ryoji Inoue et al.

It is certified that error appears in the above-identified patent and that said Letters Patent is hereby corrected as shown below:

COLUMN 4
Line 16, “from the an” should read --from an--.

COLUMN 6
Line 37, “made widen” should read --made wider--.

COLUMN 7
Line 56, “the an ink” should read --the ink--.

COLUMN 10
Line 64, “form” should read --from--.

COLUMN 11
Line 67, “from,” should read --form,--.

COLUMN 12
Line 1, “form, which” should read --form is used, which is--.

COLUMN 15
Line 32, “invent” should read --invention--;
Line 33, “invent” should read --invention--; and
Line 40, “invent” should read --invention--.

COLUMN 16
Line 19, “pomp” should read --pump--;
Line 22, “form” should read --from--; and
Line 59, “out side” should read --outside--.

UNITED STATES PATENT AND TRADEMARK OFFICE

CERTIFICATE OF CORRECTION

PATENT NO. : 7,290,861 B2
APPLICATION NO. : 10/563674
DATED : November 6, 2007
INVENTOR(S) : Ryoji Inoue et al.

It is certified that error appears in the above-identified patent and that said Letters Patent is hereby corrected as shown below:

COLUMN 17

Line 1 claim 4, “ink rank” should read --ink tank--.

Signed and Sealed this

Twelfth Day of August, 2008

JON W. DUDAS
*Director of the United States Patent and Trademark Office*